United States Patent [19]

Rosen

[11] 4,080,595

[45] Mar. 21, 1978

[54] WALLET GUARD

[76] Inventor: Leo J. Rosen, 5005 Collins Ave., Miami Beach, Fla. 33140

[21] Appl. No.: 784,040

[22] Filed: Apr. 4, 1977

[51] Int. Cl.[2] ..... G08B 13/14

[52] U.S. Cl. ..... 340/280; 340/283

[58] Field of Search ..... 340/280, 283

[56] References Cited

U.S. PATENT DOCUMENTS

| | | | |
|---|---|---|---|
| 3,930,249 | 12/1975 | Steck et al. | 340/280 |
| 3,938,126 | 2/1976 | Ransom | 340/280 |

*Primary Examiner*—Glen R. Swann, III

*Attorney, Agent, or Firm*—Ernest H. Schmidt

[57] ABSTRACT

An audible alarm device attachable to the clothing of the user has a flexible chain extending therefrom and terminating in a clip means attachable to a wallet in a nearby pocket. The interconnecting chain is wound upon a spring-stressed reel journalled within the device and having at one end an abutment member which, upon turning in response to pulling upon the chain, abuttingly contacts and moves an electrical switch actuating member from open to close circuit position for energizing a buzzer sounding an alarm that the wallet has been surreptitiously removed from the pocket.

6 Claims, 4 Drawing Figures

WALLET GUARD

BACKGROUND OF THE INVENTION

My invention relates to personal protective devices, and is directed particularly to a wallet protector or guard for alerting the wearer to the fact that his wallet is surreptitiously being withdrawn from his person, so that its theft can be prevented.

Various types of wallet and purse guarding devices have heretofore been devised, principal among which are chains of one kind or another adapted to loosely attach the wallet or purse to the person of the user. Electrical switches or the like connected in energizing circuits for audible alarms are also known to be used in association with such guard chains for alerting the user that the guarded article is being surreptitiously withdrawn from his person. Such former devices, however, are deficient in various respects, principally in that they prevent normal use of the wallet or purse without first disconnecting the attachment chain to permit full withdrawal of the wallet from the pocket being guarded. It is, accordingly, the principal object of this invention to provide a novel and improved wallet guard that obviates the deficiencies of wallet guards or alarms heretofore devised.

Summary of the Invention

A more particular object of this invention is to provide a wallet guard including a chain or cord anchoring the wallet to the person of the user, which chain is yieldingly extensible from the device secured to the clothing of the user near the pocket in which the wallet is retained and serves, upon being pulled from the device, to energize an electric buzzer warning that the wallet, together with the attached chain, is being withdrawn from the person of the user. A simple on/off switch on the device and easily accessible to the user enables de-energization of the electrical alarm to allow normal use of the wallet.

Another object of the invention is to provide an audible alarm wallet guard of the character described wherein the extensible attachment chain is sufficiently long to permit full withdrawal for use of the wallet by the wearer of the alarm device, so that the wallet always remains attached by the chain to the user. When the user returns the wallet to its pocket, the greater part of the interconnecting chain is automatically withdrawn into the nearby alarm device. At the same time the wallet is thus being returned to its pocket, the hand of the user is in position to move the de-energizing switch to the energizing position again for sounding the alarm in case an attempt is made by a pickpocket or other unauthorized person to remove the guarded wallet.

BRIEF DESCRIPTION OF THE DRAWING

Other objects, features and advantages of the invention will be apparent from the following description when read with reference to the accompanying drawings. In the drawings, wherein like reference numerals denote corresponding parts throughout the several views.

Description of the Preferred Embodiment

Figure 1:
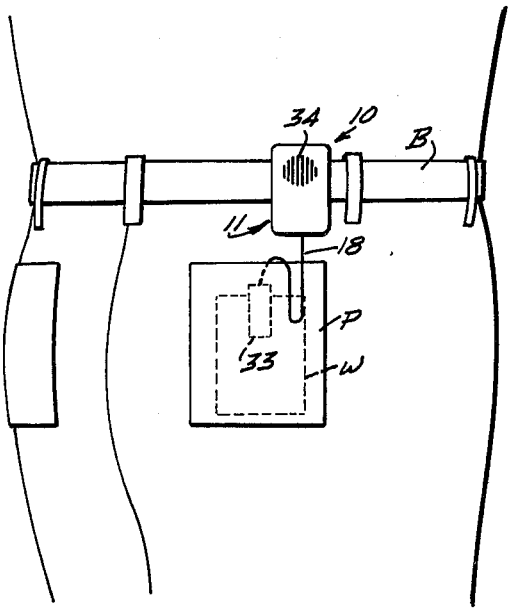
FIG. 1 is a side elevational view of a wallet guard embodying the invention, shown attached to the belt of a user for guarding a wallet in a hip pocket.
Figure 2:
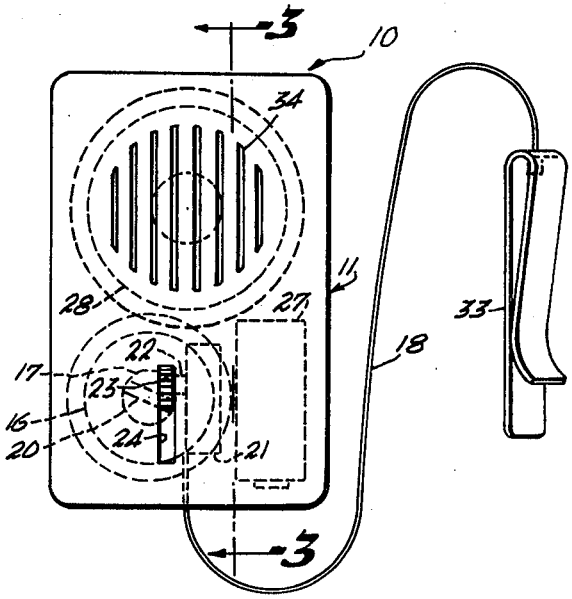
FIG. 2 is a front elevational view of the wallet guard, shown separately.
Figure 3:
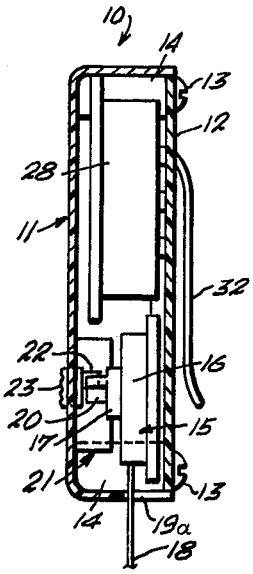
FIG. 3 is a vertical cross-sectional view taken along the line 3-3 of FIG. 2 in the direction of the arrows.

Referring now in detail to the drawings, reference numeral 10 in FIGS. 1, 2, and 3 designates, generally, a preferred form of wallet guard embodying my invention, the same comprising a shallow rectangular case or housing 11 having a back cover member 12 removably securable in place by use of screws 13 (only two illustrated in FIG. 3) receivable in corner support posts 14 integrally formed within said rectangular housing.

Figure 4:
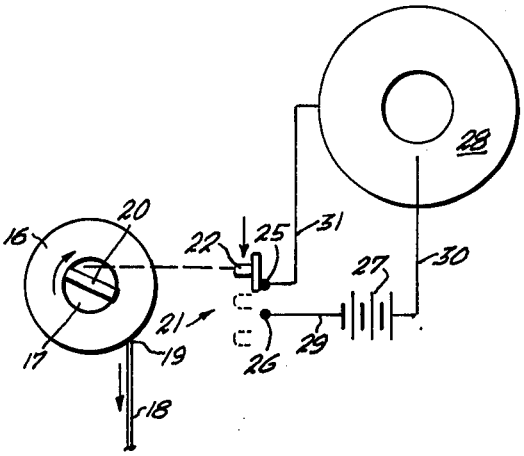
FIG. 4 is a schematic diagram illustrating the electrical alarm circuitry and associated actuating mechanism.

The housing 11 and its cover 12 will preferably be fabricated of a tough synthetic material, and may be injection molded for economy of manufacture. An attachment chain or cord return mechanism, generally indicated at 15 in FIG. 3, is secured by any convenient means within the rectangular housing 11 at the lower end thereof and to one side. The attachment chain return mechanism 15 comprises a generally cylindrical housing 16 centrally journalled within which is a reel 17 about which return cord or chain 18 is windable, said chain being extensible through a small opening 19 in said cylindrical housing. A suitable spring (not illustrated) circumjacent the reel 17 within the cylindrical housing 16 and acting between said housing and said reel serves to yieldingly urge said reel in the counterclockwise direction as illustrated in FIGS. 2 and 4 so as normally to keep the chain 18, for the most part, wound within said housing. Since the construction and operation of spring return rewinding reels are well known, a more detailed description thereof is not considered to be necessary. As best illustrated in FIGS. 3 and 4, the outwardly extending end of the chain reel 17 is integrally formed with a diametrically-extending, outwardly-projecting abutment actuating member 20 co-operatively disposed with respect to the actuation button 22 of a three-position electrical slide switch 21 against the inside of the shallow rectangular housing number 11. As further illustrated in FIGS. 2 and 3, the switch actuation button 22 has secured thereto a thumb actuated slide member 23 projecting sidewardly outwardly of a slot 24 in the face of the rectangular housing member 11

As illustrated in FIG. 4, the slide switch 21 is a normally open single-pole switch having switch contact 25, 26 adapted to be close-circuited when the actuation button 22 is moved from the position indicated by the full-line representation thereof in FIG. 4 to the next lower position, whereat the switch contacts 25 and 26 will be bridged. The electrical switch 21 controls an energization circuit comprising battery source 27 for sounding a buzzer 28, said buzzer being installed within the housing 11 above the attachment chain return mechanism 15 (see FIGS. 2 and 3). As further illustrated in FIG. 4, the energization circuit for the buzzer alarm 28 is completed through conductors 29, 30 and 31 connecting the switch contacts 25, 26, the battery of 27, and said buzzer alarm in series. As illustrated in FIG. 2, battery 27 is located within the case or housing 11 beside the attachment chain return mechanism 15.

A downwardly extending spring clip 32, one end of which is molded within or otherwise secured to the outside of the cover member 12, (see FIG. 3) serves to attach the wallet alarm device 10 with respect to the body of the user. As illustrated in FIG. 1, the spring clip 32 is used to attach the alarm device to the belt B of the wearer in the vicinity of the hip pocket P in which the wallet to be guarded is kept. As illustrated in FIGS. 1 and 2, the outer end of the chain or cord 18 is secured to a double-bent spring clip 33 which may be used to attach said chain to the wallet W, as illustrated in FIG. 1. Alternative means for attaching the end of the chain 18 to the wallet could also be used, such as an elastic band passed over the folding juncture at the mid-section thereof. The housing or case member 11 is provided in its face with a plurality of slots 34 in front of the interior buzzer alarm device 28 to permit ready passage of warning sound waves therefrom when energized. As best illustrated in FIG. 3, a slot 19*a* is provided in the bottom sidewall of the housing member 11 for through passage of the wallet attachment chain 18.

In use, the wallet guard 10 will be attached to the person of the user near the pocket P in which the wallet W is normally retained, with the spring clip 33 or other wallet attachment device secured to the wallet. The return spring of the attachment return chain mechanism 15 normally retains a substantial length of the chain or cord 18 wound around its internal reel, with a comparative short length thereof projecting freely for extension into the pocket where the wallet to be protected is kept. Thus, although the device is illustrated as being attached to the belt B of the wearer for use of a wallet W normally kept in the hip pocket, it will also be understood that it could be used for guarding wallets normally worn in other pockets, such as an inside coat pocket. When in use, the slide switch actuation button 22 will be in its first or uppermost position as illustrated in FIG. 4, whereat it is in position to be abuttingly contacted by the abutment member 20 of the chain return mechanism reel 17. If a pickpocket should attempt to withdraw the wallet W from the pocket P as illustrated in FIG. 1, pulling upon the chain or cord 18 will cause the reel 17 to rotate in the clockwise direction as illustrated in FIG. 4, whereupon the actuating abutment member 20 of said reel will come into engagement with and push down upon switch actuation button 22 moving it from the position illustrated by the full-line representation thereof in FIG. 4 to the next lowermost position whereat it will bridge the switch contacts 25, 26 to energize and thereby sound buzzer 28. This will immediately alert the wearer so that he can take whatever action may be appropriate to thwart the theft of his wallet.

The thumb actuated slide member 23 can be used either to move the actuation button 22 to its uppermost ready position again, after the cord or chain 18 has been allowed to be retracted upon the reel 17, to place the device in operative position again. Whenever the user wishes to withdraw the wallet for his own use, it is only necessary for him to manually push the thumb actuated slide member 23 downwardly to its lowermost position as illustrated in FIG. 4 before removing his wallet, whereat the actuation button 22 will be at open-switch position and at the same time out of range for actuation upon turning of the reel 17. The thumb actuated slide member 23 thus allows the user to set the device either in operating or non-operating condition, as required. In this connection it is to be noted that the chain 18 is long enough so that when withdrawn from its attachment chain return mechanism 15, the wearer can make normal use of the guarded wallet without difficulty or inconvenience either in withdrawing the wallet or returning it to its pocket.

While I have illustrated and described herein only one form in which my invention can conveniently be embodied in practice, it is to be understood that this embodiment is given by way of example and not in a limiting sense. My invention, in brief, comprises all the embodiments and modifications coming within the scope and spirit of the following claims:

What I claim as new and desire to secure by Letters Patent is:

1. A wallet guard comprising, in combination, a housing member, a flexible chain, a chain return spring mechanism within said housing member and having journalled therein a reel about which one end of said chain is attached and windable, the other end of said flexible chain extending through an opening in said housing member and terminating in means for attachment to a wallet to be guarded, an alarm device in said housing member, normally inactive energizing means for said alarm device, and means controlled by rotation of said reel upon withdrawal of said interconnecting chain for activating said energizing means for operating said alarm device.

2. A wallet guard as defined in claim 1, wherein said alarm device comprises an electrically energized audible alarm, wherein said energizing means comprises an electrical circuit providing a source of electrical current, and wherein said spool rotation control means comprises an electrical switch in said electrical circuit.

3. A wallet guard as defined in claim 2, including manual control means for independently actuating said electrical switch.

4. A wallet guard as defined in claim 3, including means for removably attaching said housing member to the clothing.

5. A wallet guard as defined in claim 4, wherein said wallet attachment means comprises a spring clip.

6. A wallet guard as defined in claim 5, wherein said clothing attachment means comprises a second spring clip.

* * * * *